United States Patent [19]

Adams

[11] 4,253,852

[45] Mar. 3, 1981

[54] AIR PURIFIER AND IONIZER

[75] Inventor: Paul C. Adams, Berkeley, Calif.

[73] Assignee: TAU Systems, Berkeley, Calif.

[21] Appl. No.: 92,784

[22] Filed: Nov. 8, 1979

[51] Int. Cl.[3] ..... B03C 3/09; B03C 3/32; B03C 3/41

[52] U.S. Cl. ..... 55/126; 55/136; 55/141; 55/150; 55/279; 422/121; 361/230

[58] Field of Search ..... 55/105, 106, 113, 126, 55/131, 136, 141, 150, 210, 212, 279; 422/4, 22, 120, 121, 122; 361/229, 230

[56] References Cited

U.S. PATENT DOCUMENTS

| | | | |
|---|---|---|---|
| 1,049,775 | 1/1913 | Spaulding | 55/279 |
| 2,343,338 | 3/1944 | Steel | 422/4 |
| 2,860,723 | 11/1958 | Wintermute | 55/105 |
| 3,247,374 | 4/1966 | Wintermute | 422/4 |
| 3,374,941 | 3/1968 | Okress | 55/136 |
| 3,654,534 | 4/1972 | Fischer | 55/126 |
| 3,740,926 | 6/1973 | Duval | 55/126 |
| 3,844,741 | 10/1974 | Dimitrik | 55/126 |
| 3,910,778 | 10/1975 | Shahgholi et al. | 55/131 |
| 3,973,927 | 8/1976 | Furchner et al. | 55/106 |
| 3,973,932 | 8/1976 | Alskog | 55/113 |

*Primary Examiner*—David L. Lacey
*Attorney, Agent, or Firm*—Townsend & Townsend

[57] ABSTRACT

An improved electrostatic air purifier and ionizer combining the functions of filtration, precipitation and generation of negative ions. An intake fan draws ambient air within a room into the device through a mechanical filter. The filtered air then passes through an electrostatic field created between an upstream positively charged silver or silver-alloy electrode, preferably in the form of a wire screen or mesh, and a downstream negatively charged gold or gold alloy electrode, preferably in the form of a number of thin strands of wire strung across the air flow path. The interelectrode voltage and fan speed are individually adjustable to optimize the ionizer output to the environment in which it operates.

9 Claims, 4 Drawing Figures

AIR PURIFIER AND IONIZER

FIELD OF THE INVENTION

The present invention relates to air ionizers and is more particularly directed to an improved electrostatic negative ion generator and precipitator.

DESCRIPTION OF THE PRIOR ART

It is well known to use various types of ionization devices to remove particulate matter such as dust, smoke, pollen, etc. from the air. These devices typically operate by attacting charged particles to an oppositely charged collecting surface. The particles may be present in a charged state in the atmosphere or they may be charged within the device. Precipitation may occur both within the device and after the charged particles are reintroduced into the surrounding air. In the latter case, the negatively charged particles issuing from the ionizer are sometimes referred to as "large ions".

In addition to precipitating particulate matter which flows through the ionizer, such devices also purify the surrounding air by producing negatively charged air-constituent molecules, primarily oxygen ($O_2$), which are sometimes called "small ions". Because particles in the air such as dust and smoke typically have a naturally occurring positive charge, they are kept in suspension in the air by electrostatic repulsion from various indoor surfaces constructed of synthetic materials which are also positively charged. When such positively charged particles interact with the small ions generated by the ionizer, they acquire a negative charge and are attracted to these surfaces where they may be collected.

As to the small ions—e.g. the negatively charged $O_2$ molecules—it has been demonstrated that the presence of such negative ions in the air produces beneficial physiological and psychological effects. For example, the invigorating feeling people typically experience when in the mountains has been attributed to the larger concentration of negative ions at high altitudes which results from, among other things, more intense ultraviolet radiation due to the thinner atmosphere. Other ways in which negative ions are naturally produced include electrostatic discharge from lightning; radiation from naturally occurring radioactive material such as radium, radon and uranium; and falling water in the form of rain, waterfalls, or crashing waves.

Man-made devices used to produce negative ions typically employ either a radioactive source, ultraviolet light or an electrostatic field. The use of radioactive substances to produce negative ions has obvious drawbacks in terms of safety. Ultraviolet ionizers, in additon to consuming relatively large amounts of electrical power, also require that the electron emitting material which is exposed to the ultraviolet radiation be periodically renewed. There is also the necessity in such devices of shielding the user from the potentially harmful ultraviolet radiation.

Prior art negative ion generators using an electrostatic field have been found to produce undesirable amounts of ozone. Ozone is a very strong bleaching and oxidizing agent which can be quite toxic in amounts above the presently accepted safety level of only 0.12 ppm.

The amount of ozone produced by any particular ionizer operating at a given voltage depends on a variety of environmental factors including:

(1) the quantity and ratio of positive and negative ions in the surrounding atmosphere;

(2) the extent of pollution in the air;

(3) ambient humidity;

(4) barometric pressure;

(5) temperature; and (6) the presence of electrostatic fields in proximity to the device.

SUMMARY OF THE INVENTION

The present invention is an improved electrostatic air purifier and negative ion generator employing a unique combination of electrode materials in a particular configuration which produces markedly superior physiological and psychological effects upon the occupants of a room in which the device is operating. Air purification is achieved by a combination of mechanical filtration within the device and electrostatic precipitation both within and outside the unit. The invention provides the capability of controlling both the interelectrode voltage and the volume air flow rate through the device in order to accommodate varying environmental conditions as outlined above thereby eliminating or at least minimizing the production of undesirable ozone.

According to a preferred embodiment of the invention, an intake fan draws ambient air within a room into the device through a mechanical filter. The air flow then passes through an electrostatic field created between an upstream positively charged silver or silver alloy electrode, preferably in the form of a wire screen or mesh, and a downstream negatively charged gold or gold alloy electrode, preferably in the form of a number of thin strands of wire strung across the air flow path. Th interelectrode voltages are typically in the range of 3,000 to 5,000 volts DC. The combination of silver and gold (or their alloys) on the respective surfaces of the upstream positive electrode and downstream negative electrode generates small ions which when breathed or absorbed by humans have been found to produce some or all of the following effects in a markedly superior way through a mechanism which is not yet completely understood but which is not achievable with other materials: (1) clarified consciousness; (2) enhanced mental functioning; (3) mild stimulation; (4) a general sense of well being; (5) clearing of nasal, sinus and bronchial passages; and (6) ease of respiration.

It should be noted that the use of gold and/or silver on an active surface has been suggested in connection with ultraviolet ionizers (e.g. see U.S. Pat. No. 3,247,374 issued to Wintermute). These materials were favored because of their low photoelectric work function and resistance to corrosion. However, the superior performance of the gold-silver combination which is at the heart of the present invention has not been heretofore recognized in the design of electrostatic ionizers.

Flexibility in use is achieved by the ability to simultaneously adjust both interelectrode voltage and fan speed to optimize the ionizer output to the environment in which it operates. In addition to those factors mentioned above in connection with ozone production, this includes the size of the room, the number of people in the room and the degree of air ionization and purification desired. For example, as the ambient humidity within a room changes so does the amount of ozone which will be produced at a given voltage setting. In order to maintain or increase the efficiency of the device in such a situation, the electrode voltage and fan speed (air flow) would be changed to compensate for the change in humidity with a consequent maintenance of the negative ionization level in the room without an attendant increase in ozone production.

Preferably, the two electrodes are housed in a cartridge assembly which is easily removed from the unit. This allows the electrode elements to be easily cleaned when necessary due to contaminant build up on the electrode surface.

Additional objects and features of the invention will appear from the following description in which the constructional details of the preferred embodiment have been set forth in reference to the accompanying drawings.

DETAILED DESCRIPTION OF THE PREFERRED EMBODIMENT

Figure 1:
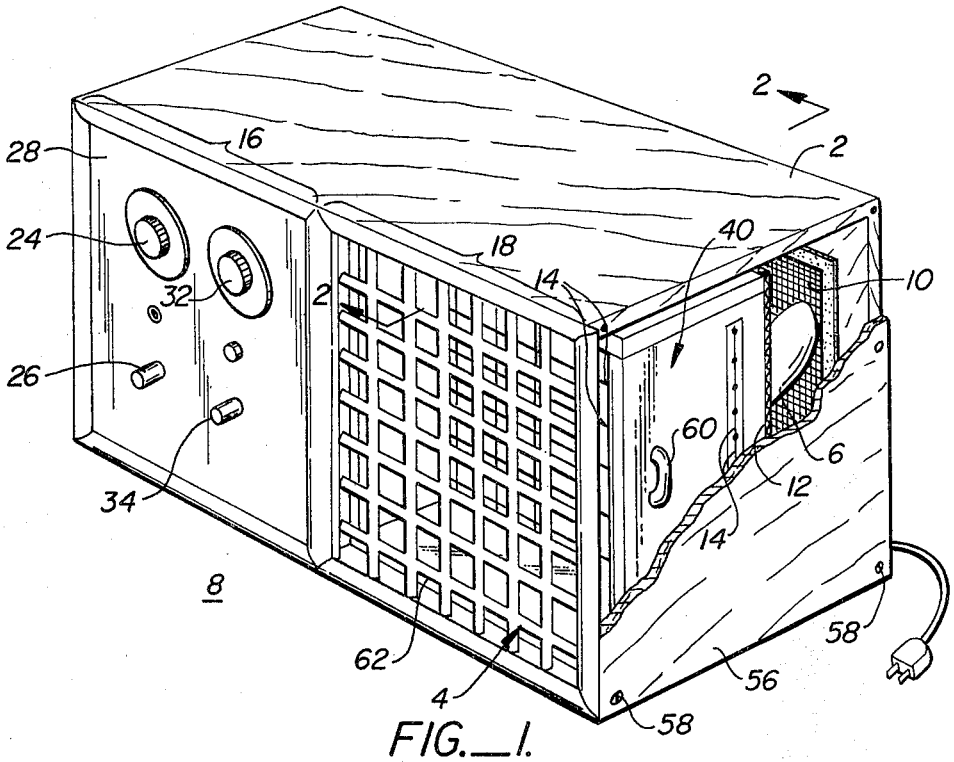
FIG. 1 is an isometric view of the invention with a part of the side broken away to show the interior construction.
Figure 2:
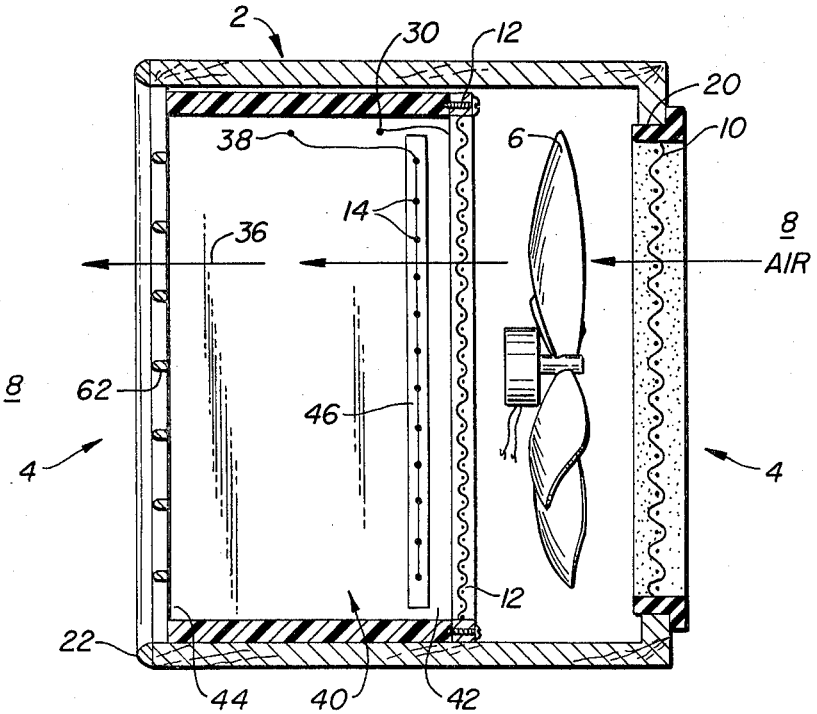
FIG. 2 is a vertical cross-sectional view of the invention taken along lines 2—2 of FIG. 1.
Figure 3:
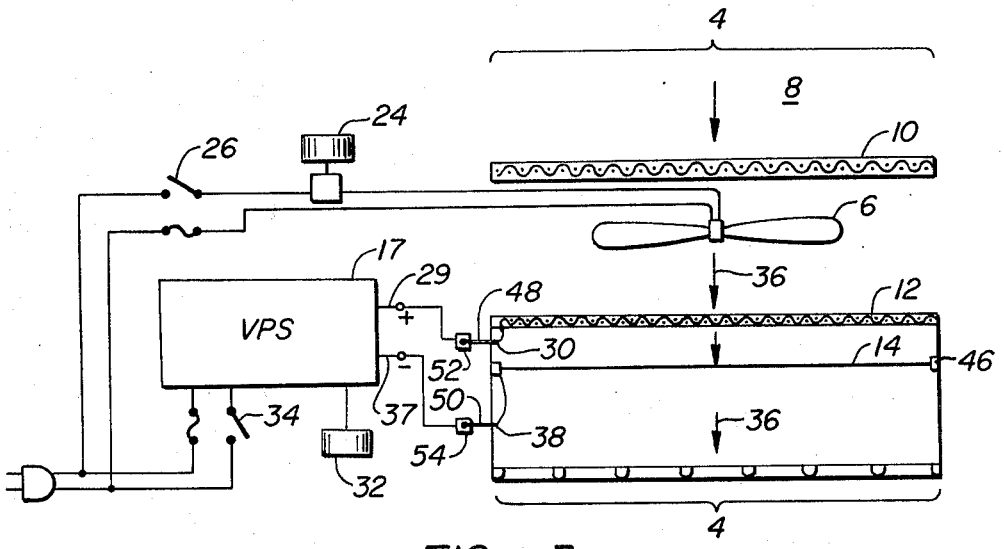
FIG. 3 is a schematic representation of the major components and electrical interconnections of the invention.

Referring to FIGS. 1–3 the invention is seen to generally comprise a housing 2 defining an air flow passageway 4, in which a fan 6 draws air from an enclosed air space or room 8 through a mechanical filter 10, past a first, positively charged electrode 12, past a second, negatively charged electrode 14, and back into room 8.

Housing 2 is seen to be a rectangular box having two sections. A first section 16 houses a direct current variable power supply 17 (hereinafter VPS) and assorted electrical circuitry and components. A second section 18 defines passageway 4. Passageway 4 is a generally rectangular duct, the open ends of which are defined by entrance 20 and exit 22. Covering entrance 20 is mechanical filter 10. Air passing through passageway 4 is thus first mechanically filtered to remove relatively large particulate matter from the air.

Fan 6 is mounted within passageway 4 adjacent to filter 10 and positioned to draw air from room 8 through the filter. Fan 6 is preferably a variable speed fan which is controlled by a fan control knob 24 and a fan switch 26, both mounted to the front panel 28 of section 16. Switch 26 acts to turn fan 6 on and off while knob 24 acts to control the speed of fan 6.

Electrode 12 is mounted within passageway 4 so that air moving through the passageway flows past electrode 12 first and then past electrode 14. Electrode 12 is, in this preferred embodiment, silver plated copper wire mesh having a one-sixteenth inch mesh size. Electrode 12 is connected to the positive voltage terminal 29 of VPS 17 via terminal 30. The details of the electrical connections are described below. A power supply switch 34, mounted to front panel 28 controls the electrical power to VPS 17 from a power source, not shown, which is typically 110 VAC house current.

Electrode 14 is mounted parallel to electrode 12 so that the air flowing through passageway 4 flows first past electrode 12 and then past electrode 14. Electrode 14 is a plurality of gold wire segments strung transversely to the air flow path 36. In this embodiment electrode 14 is made of 2 mil gold wire mounted approximately three-quarters of an inch from and parallel to electrode 12. Electrode 14 is electrically connected to the negative terminal 37 of VPS 17 via terminal 38. VPS 17 supplies electrodes 12 and 14 with an interelectrode voltage potential in the range of 3,000 to 5,000 VDC. Knob 32 is used to control and vary the output of VPS 17 to electrodes 12 and 14 at the desired voltage levels. Although in this embodiment one control knob 32 controls the potential at both electrodes, separately set potentials may also be provided so long as electrode 14 is negatively charged with respect to electrode 12. The degree of electrostatic precipitation is affected by both the potential at the electrodes and by the geometries of the electrodes. Thus, the geometries of, as well as the voltage potentials supplied to, such electrodes can be changed to suit individual needs. However, a change in geometry may alter the effectiveness of the invention as an air ionizer. The ability to change the electrode geometry is facilitated by mounting electrodes 12, 14 within a removable cartridge 40, as described below.

Figure 4:
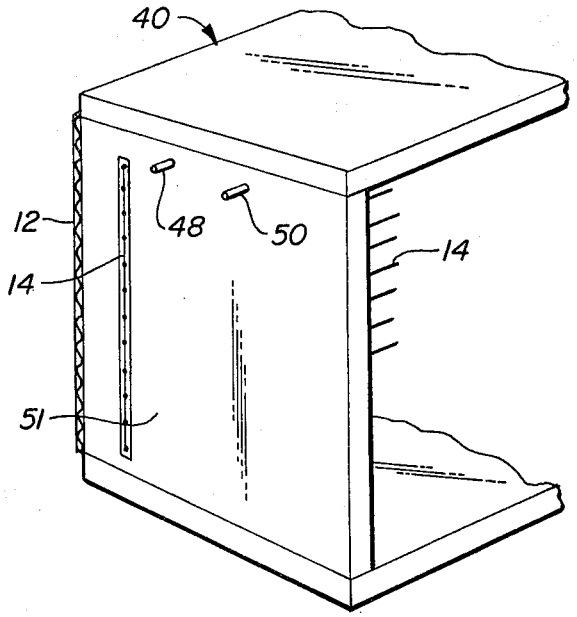
FIG. 4 is a side view of the cartridge.

To make electrodes 12, 14 more readily accessible, electrodes 12, 14 are mounted in cartridge 40. Cartridge 40 is a rectangular box made of electrically insulating material, such as an acrylic resin plastic sheet, and sized to snugly fit within passageway 4. Cartridge 40 has no top or bottom; it has only sides which contact the walls of passageway 4 so that the passage of air through passageway 4 is substantially unimpeded by cartridge 40 from its entrance 42 to its exit 44. In the preferred embodiment electrode 12 is mounted at entrance 42 along the edge of cartridge 40. Electrode 14 is strung between opposite sides of cartridge 40 at terminal strips 46. First and second electrodes 12, 14 are electrically connected to banana plugs 48, 50 through terminals 30, 38 respectively. Plugs 48, 50 are mounted to the outside of side 51 of cartridge 40 (See FIG. 4) and mate with corresponding receptacles 52, 54 when cartridge 40 is fully inserted into passageway 4. Receptacles 52, 54 are electrically connected to terminals 29, 37 respectively.

To remove cartridge 40, side 56 of housing 2 is removed by removing screws 58. Cartridge 40 is then removed by grasping a handle 60 mounted to the side of the cartridge and sliding the cartridge out of the housing. Electrical disconnection is through the disengagement of respective plugs 48, 50 from receptacles 52, 54. The electrodes can then be easily cleaned, repaired, or replaced. Cartridge 40 is reinserted within passageway 4 in the reverse order.

In operation, the air flowing along path 36 passes through an electric field created between electrodes 12, 14. This field ionizes the air. The ionized air continues along path 36 through outlet vent 62 past exit end 22 and into room 8. The sides of cartridge 40, vent 62 and exit end 22 are all made of non-conducting material so the ionized air will not become neutralized prior to entering room 8. For example, vent 62 and cartridge 40 may be plastic and exit end 22 may be wood. Using these non-conducting materials insures that a maximum number of oxygen ions are released into the air and not neutralized by an electrically conductive surface. This feature increases the efficiency of the unit.

Using the device is particularly simple. The unit is first plugged in into any standard household outlet. The fan and the VPS are both turned on and their respective speed and output adjusted. The user then reaps the benefits flowing from the use of the invention by breathing (and absorbing through the skin) the treated and purified air.

Thus, although the best mode contemplated for carrying out the present invention has been herein shown and described, it will be apparent that modification and variation may be made without departing from the spirit and scope of the invention as defined by the appended claims.

I claim:

1. An air purifier and ionizer for use in an enclosed area comprising:

a housing having a passageway extending therethrough, said passageway having an entrance end and an exit end in communication with the air in said area;

means for inducing an air flow through said passageway from said entrance to said exit;

a first electrode mounted within said passageway, the active surface of said first electrode consisting essentially of silver;

a second electrode mounted within said passageway spaced from and downstream of said first electrode, the active surface of said second electrode consisting essentially of gold; and means for imposing an electric field between said first and second electrodes with an interelectrode voltage potential such that said second electrode is negatively charged with respect to said first electrode.

2. The device of claim 1 wherein:

said air flow inducing means further includes means for varying the volumetric air flow rate through said passageway; and said electric field imposing means is a variable voltage power-supply.

3. The device of claim 2 wherein:

said first electrode is a silver-plated copper wire screen; and said second electrode comprises a plurality of thin gold wires mounted in a plane parallel to said screen.

4. The device of claim 2 further comprising a filter mounted across said passageway.

5. The device of claim 2 wherein said electrodes are mounted in a removable mounting means within said passageway.

6. In an air ionizer of the type having a housing with a passageway in which first and second electrodes are mounted, a variable speed fan for forcing air successively past the first and second electrodes, a variable power supply for creating an electric field between the electrodes, the improvement comprising:

said first electrode consisting essentially of silver; and said second electrode spaced from and downstream of said first electrode and consisting essentially of gold.

7. The ionizer of claim 6 wherein said second electrode is negatively charged with respect to said first electrode.

8. The ionizer of claim 7 wherein said first electrode is a silver plated copper wire mesh and said second electrode is a plurality of fine gold wires strung generally parallel to said first electrode.

9. The ionizer of claim 8 further comprising means for removably mounting said electrodes within said passageway.

* * * * *